US006629819B1

(12) United States Patent
Brown et al.

(10) Patent No.: US 6,629,819 B1
(45) Date of Patent: Oct. 7, 2003

(54) STEAM TURBINE LOW PRESSURE INLET FLOW CONDITIONER AND RELATED METHOD

(75) Inventors: Daniel M. Brown, Altamont, NY (US); George Kirby, Newburyport, MA (US); Richard Mattice, Broadalbin, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/143,873

(22) Filed: May 14, 2002

(51) Int. Cl.[7] ..... F01D 9/00
(52) U.S. Cl. ..... 415/208.1
(58) Field of Search ..... 415/182.1, 208.1, 415/211.1, 214.1, 220, 221, 914

(56) References Cited

U.S. PATENT DOCUMENTS 4,232,993 A * 11/1980 Ikeda et al. ..... 415/220 X
4,863,341 A * 9/1989 Groenendaal ..... 415/103
5,340,276 A 8/1994 Norris et al.
5,603,604 A 2/1997 Norris et al.
6,363,724 B1 4/2002 Bechtel et al.

* cited by examiner

*Primary Examiner*—Edward K. Look
*Assistant Examiner*—Richard A. Edgar
(74) *Attorney, Agent, or Firm*—Nixon & Vanderhye P.C.

(57) ABSTRACT

A flow conditioner for a steam turbine inlet includes an annular ring adapted to seat in a flange portion of an inlet in a turbine casing and a pair of wing portions extending from the annular ring in a flow direction, away from the annular ring. A related method of smoothing flow through an inlet of a steam turbine inlet casing wherein the inlet includes a circular flange and a non-circular transition portion extending between the annular flange and a main body portion of the steam turbine casing includes the steps of a) identifying surface discontinuities that disrupt flow of working fluid through the steam inlet; b) providing a flow conditioner that is shaped to conceal one or more of the surface discontinuities; and c) inserting the flow conditioner into the inlet.

14 Claims, 3 Drawing Sheets

STEAM TURBINE LOW PRESSURE INLET FLOW CONDITIONER AND RELATED METHOD

BACKGROUND OF THE INVENTION

This invention relates to turbomachinery in general and to a flow conditioner for a low pressure inlet in a steam turbine in particular.

A low pressure (LP) inlet in a steam turbine casing is designed to transfer working fluid (steam) from the power plant piping to the LP turbine unit. The steam may be generated in, for example, a heat recovery steam generator in a combined cycle power plant. It has been found that obstructions and discontinuities in the inlet passage surfaces of the steam turbine casing tend to increase the energy loss of the steam. This lost energy is not available for use by the steam turbine, thereby reducing the overall efficiency of the turbine.

One such surface discontinuity is a back-facing step (or back step) created by a pipe flange of circular cross-section joined to a polygonal, faceted inlet structure of the casing. Other discontinuities arise in that the faceted inlet structure transitions from a polygonal cross section adjacent the pipe flange to a substantially rectangular cross section downstream of the flange (in the flow direction) via a plurality of flat surfaces.

Prior methods of reducing energy loss in the LP inlet are summarized below:

(1) Metering flow upstream of the inlet—while this may reduce losses in the inlet proper, metering of the flow anywhere in the flow path generates energy loss. For other reasons, it may be necessary to meter the flow upstream of the inlet step and thereby mitigate losses at the step. In this case, there will be no additional loss. However, metering of the flow is not an effective method if used to specifically target energy loss associated with a back-facing step.

(2) Contouring the inlet walls—this technique redistributes the velocity profile at the $1^{st}$ stage nozzle, but there is no method of reacquiring the lost energy associated with the back step to the LP inlet.

(3) Using larger pipe diameter—this is an effective method of slowing the steam flow velocity since losses are proportional to the square of velocity. The disadvantage of this method, however, is that the cost of the piping increases with diameter. Furthermore, this method may influence the velocity profile at the $1^{st}$ stage nozzle.

There remains a need for a technique or device that conceals the back step from the flow path and that has either beneficial or no influence on the $1^{st}$ stage velocity profile.

BRIEF DESCRIPTION OF THE INVENTION

In an exemplary embodiment of this invention, a "flow conditioner" constructed of an appropriate material is provided that may be inserted (as a retrofit), or designed into the LP inlet of a steam turbine casing to reduce energy loss of the working fluid. The flow conditioner in the exemplary embodiment conceals the back facing step generated at the interface of the round inlet pipe flange and the polygonal LP inlet, and otherwise presents a smoothly contoured surface to the flowing fluid in the inlet transition area. While the exact profile of the flow conditioner necessarily varies for each application, the device as described herein includes a round axially oriented inlet edge, i.e., a cylindrical inlet portion concentric with the longitudinal axis of the LP inlet. Downstream of the cylindrical inlet, the flow conditioner presents a pair of smoothly tapered (downwardly and outwardly in the flow direction) surfaces, or "wings," diametrically opposed to each other, and each initially spanning about 180° of the cylindrical inlet. These surfaces each have side edges that taper towards each other, so that the terminal edge of each wing, when viewed in plan, circumscribe an angle of only about 25° relative to the center axis. The generally parallel terminating edges of each wing correspond to the width dimension of the two shorter sides of the rectangular cross section further within the LP inlet. It will be appreciated that the side edges of one wing merge smoothly into the side edges of the other wing, and lie in angled planes such that they seat on inwardly tapered flat surfaces of the LP inlet. The smoothly contoured wings thus not only conceal the back facing step at the round inlet pipe flange, but also the corners or edges where the flat surfaces of the LP inlet interface or join to each other, thus smoothing the flow through the inlet.

In its broader aspects, the invention thus relates to a flow conditioner for a steam turbine inlet comprising an annular ring adapted to seat in a flange portion of an inlet in a turbine casing and a pair of wing portions extending from the annular ring in a flow direction, away from the annular ring.

In another aspect, the invention relates to a turbine inlet casing having a main body portion and a steam inlet in communication with the main body portion, the steam inlet including an annular flange and a transition portion extending between the annular flange and the main body portion, the annular flange and transition portion generating a back facing step at an interface thereof; and a flow conditioner inserted within the inlet concealing the back facing step to thereby smooth flow through the inlet.

In still another aspect, the invention relates to a method of smoothing flow through an inlet of a steam turbine inlet casing wherein the inlet includes a circular flange and a non-circular transition portion extending between the annular flange and a main body portion of the steam turbine casing, the method comprising a) identifying surface discontinuities that disrupt flow of working fluid through the steam inlet; b) providing a flow conditioner that is shaped to conceal one or more of the surface discontinuities; and c) inserting the flow conditioner into the inlet.

The invention will now be described in detail in connection with the drawings.

DETAILED DESCRIPTION OF THE INVENTION

Figure 1:
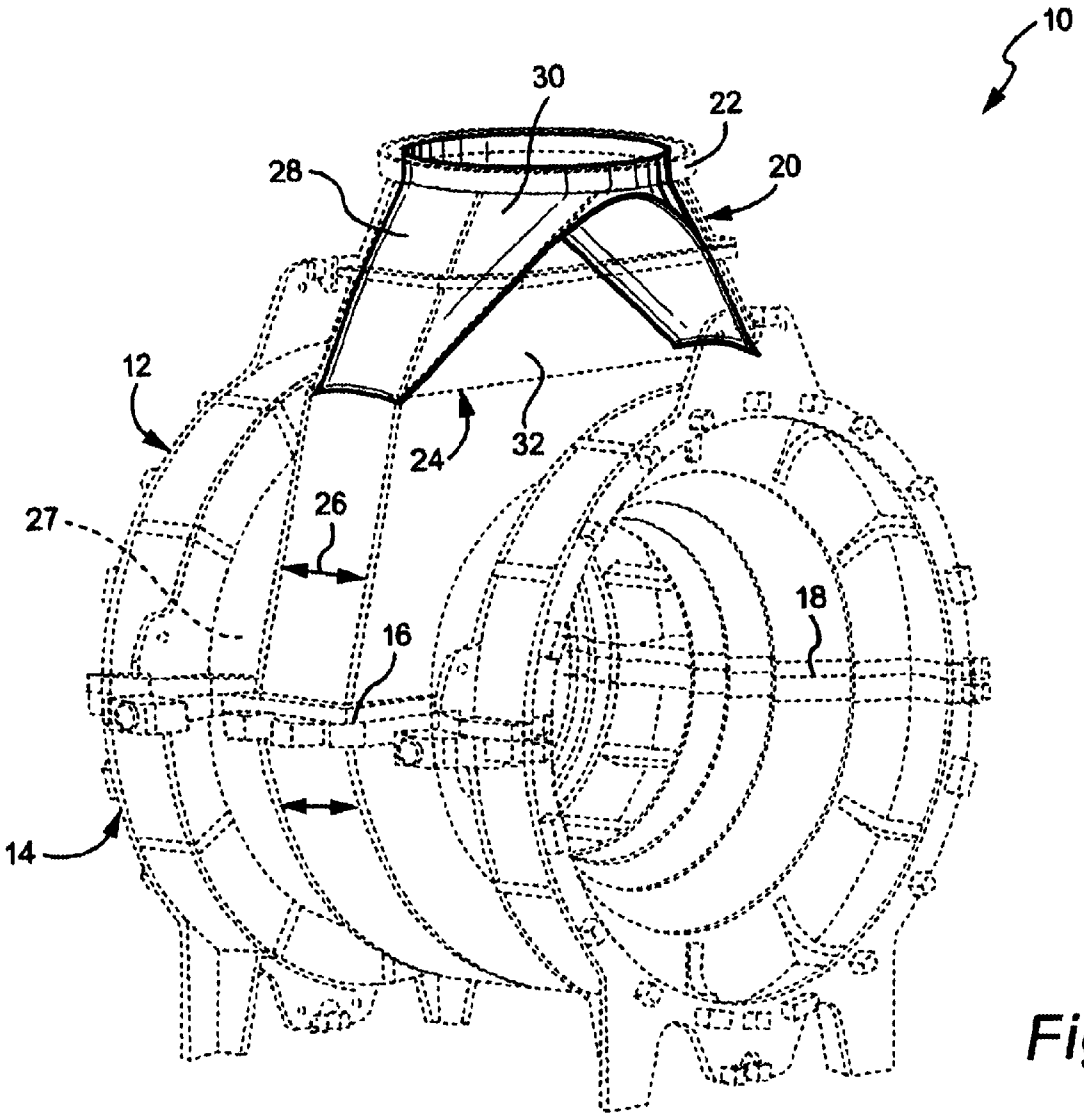
FIG. 1 is a perspective view of a flow conditioner in accordance with the invention inserted within the low pressure inlet of a steam turbine casing, the casing shown in dotted lines to permit visibility of the flow conditioner enclosed therein.

With reference initially to FIG. 1, a steam turbine low pressure (LP) inlet casing 10 is generally cylindrical in shape and includes upper and lower sections 12, 14 joined together by bolts or the like along horizontal joint lines 16, 18. The upper section 12 is formed with a steam inlet 20 that includes a circular or annular pipe joint flange (or "flange portion") 22 by which the inlet 20 is connected to a circular pipe or other conduit that supplies low pressure steam to the LP casing 10. The inlet 20 includes a transition portion that varies in cross-sectional shape from round at the flange 22 to polygonal just below the flange 22, to substantially rectangular at a location or portion designated by reference numeral 24, having a width indicated at 26. The inlet continues beyond the location 24 and merges into the main body portion 27 of the casing. The transition from a polygonal cross section to a rectangular cross section is effected by means of a series of flat surfaces, three of which, 28, 30, 32, are seen in FIG. 1. It will be appreciated that the LP inlet includes a pair of the end plates 28, a pair of side plates 32, and two pairs of the intermediate plates 30, in a symmetrical array about a vertical center line through the inlet. Note that the side plates 32 taper inwardly in the flow direction, since the diameter at the flange 22 is greater than the width dimension 26.

Figure 2:
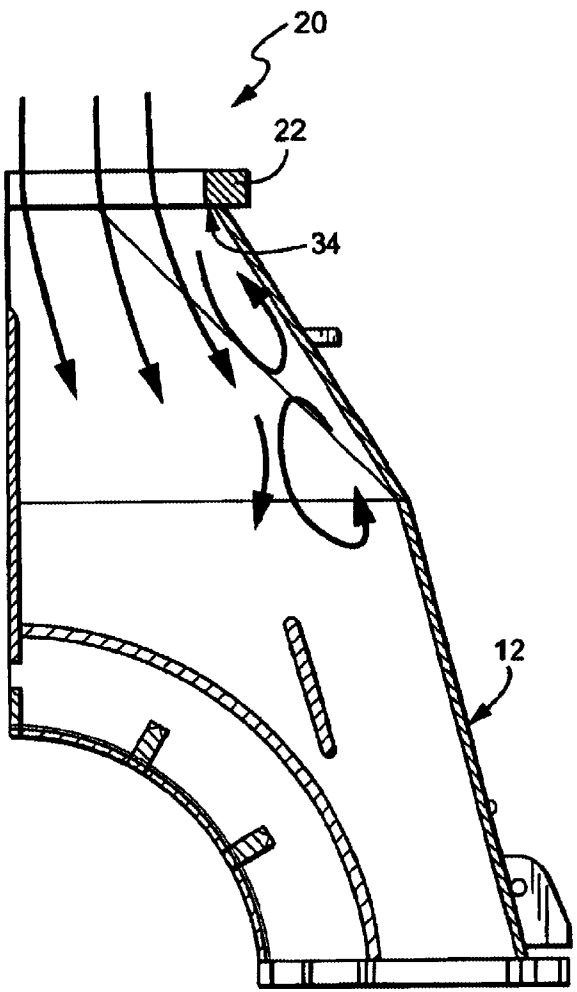
Fig. 2 (Prior Art)
FIG. 2 is a partial cross section of the turbine inlet casing of FIG. 1, without the flow conditioner, and illustrating the flow pattern created by a back facing step in the LP inlet.
Figure 3:
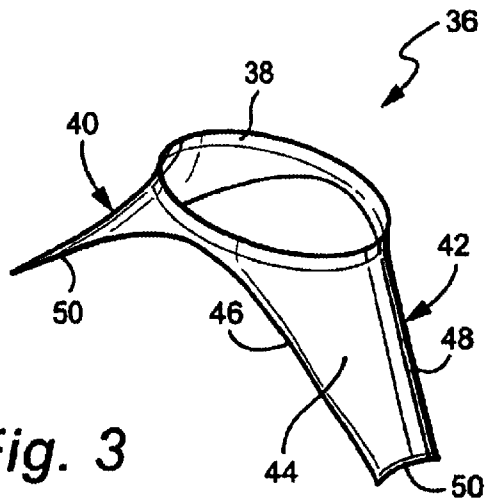
FIG. 3 is a perspective view of the flow conditioner in accordance with an exemplary embodiment of the invention.
Figure 6:
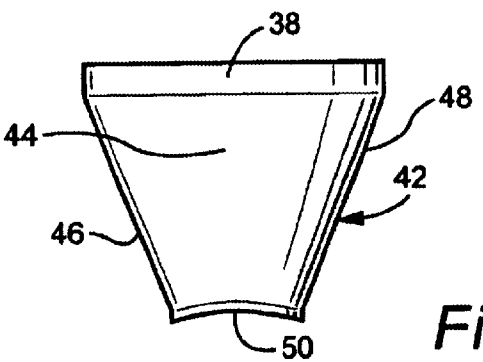
FIG. 6 is a side elevation of the flow conditioner shown in FIG. 5.
Figure 4:
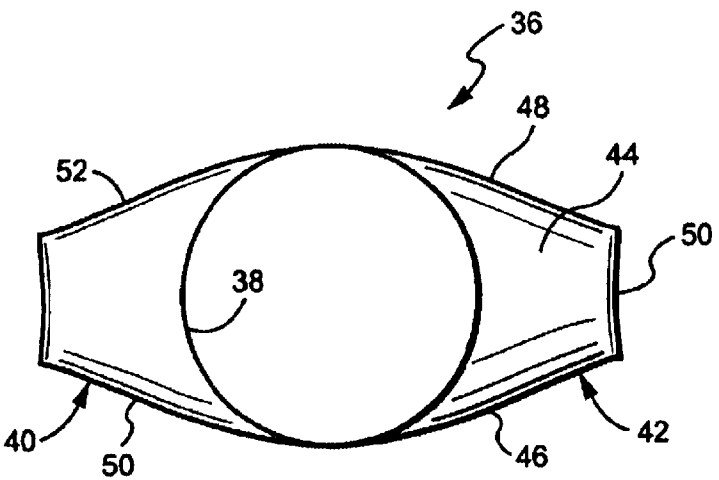
FIG. 4 is a plan view of the flow conditioner shown in FIG. 3.
Figure 5:
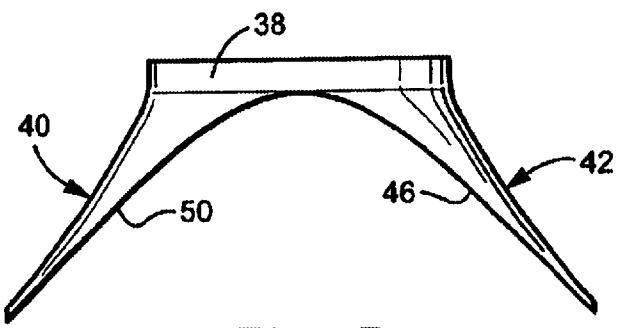
FIG. 5 is a front elevation of the flow conditioner shown in FIG. 4.

FIG. 2 illustrates the backward facing step that disrupts the flow (indicated by the flow arrows), preventing the flow from remaining attached to the inlet walls. Further disruption may also be caused by the edgewise interfaces between the various flat surfaces 28, 30 and 32. FIGS. 3—7 illustrate in detail a flow conditioner 36 in accordance with an exemplary embodiment of the invention. It includes an annular ring 38 at an upstream end (relative to the flow direction) that is adapted to seat within the annular pipe joint flange 22 and to be welded thereto. A pair of contoured "wings" 40, 42 project downwardly (downstream in the flow direction) and outwardly from diametrically opposite portions of the annular ring 38.

The wings 40, 42 (or "wing portions") are identical and thus only one need be described in detail. Wing 42 has a generally convex surface portion 44, with side edges 46, 48 that taper inwardly from the ring 38 to a remote, truncated edge 50. In other words, when viewed in plan (FIG. 4), the wing 42 tapers from the diameter of ring 38 to the width dimension 26 of the inlet transition at location 24. The side edges 46, 48 merge smoothly into like side edges 52, 54, respectively of the wing 40. Each contiguous pair of the side edges 46, 52 and 48, 54, respectively, lie in respective flat planes, such that, when installed, edges 46, 52, for example, lie flush along the flat surface 32 of the inlet 20.

The shape of the conditioner below the ring 38 may also be described as being a convex profile swept 360° to form a "bell" shape. Diametrically opposite sides are then trimmed or cut out to form the edges 46, 48, 52 and 54 such that the flow conditioner contacts and/or covers the inside surfaces of the plates 28, 30, and 32 in the area of the inlet transition.

Returning to FIG. 1, it can be seen that the flow conditioner 36 conceals the back facing step 34 and also conceals the angled corners at the interfaces of the flat surfaces 28, 30, 32 about the inlet 20.

Figure 7:
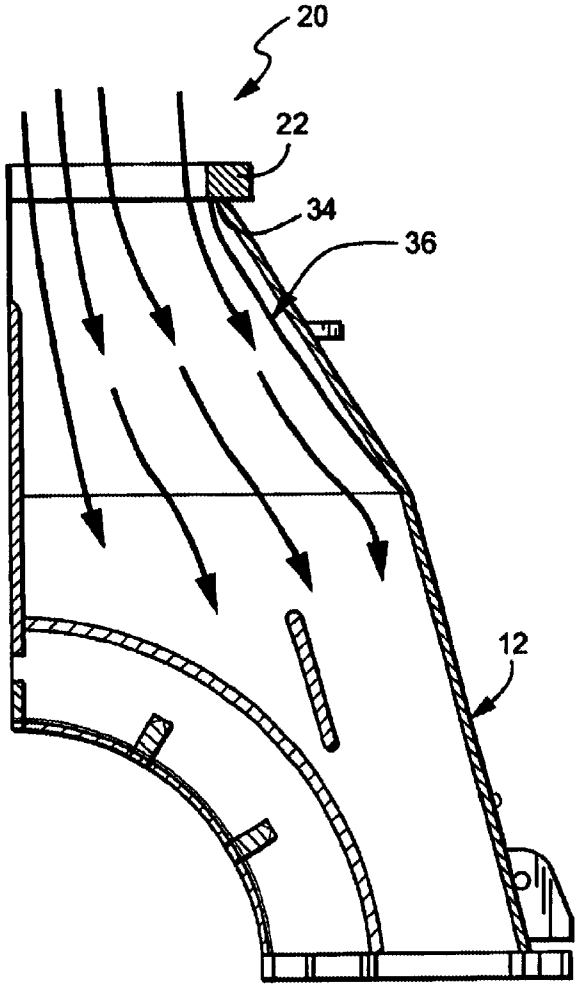
FIG. 7 is a partial cross section similar to FIG. 2, but with the flow conditioner added and illustrating the smoothed flow of working fluid through the inlet.

FIG. 7 illustrates the smoothed flow path that results from the utilization of the flow conditioner 36, thus providing a solution to the energy loss problem, while having no bearing on the uniformity of the velocity profile at the first stage nozzle of the turbine. As already mentioned, it will be appreciated that the exact shape of the flow conditioner will necessarily vary for different applications, i.e., wherever steam is fed from an external pipe of circular cross section into an inlet entrance of non-circular cross section. Material selection wall thickness, bend radius, etc. are variable depending on specific applications. This is also true with respect to attachment method and/or location. In addition, the flow conditioner may be manufactured as a single unit, or in pieces for ease of installation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A flow conditioner for a steam turbine inlet casing comprising an annular ring adapted to seat in a flange portion of an inlet in the turbine casing and a pair of wing portions extending from said annular ring in a flow direction, away from said annular ring.

2. The flow conditioner of claim 1 wherein each of said wing portions has exterior, convexly curved surfaces.

3. The flow conditioner of claim 2 wherein each of said wing portions tapers inwardly in the flow direction.

4. The flow conditioner of claim 3 wherein each of said wing portions also extend radially away from said annular ring in the flow direction.

5. The flow conditioner of claim 3 wherein one of said wings has a pair of side edges that are contiguous with a pair of side edges on the other of said wings.

6. The flow conditioner of claim 5 wherein the contiguous side edges lie in a flat plane.

7. A turbine inlet casing having a main body portion and a steam inlet in communication with the main body portion, said steam inlet including an annular flange and a transition portion extending between said annular flange and said main body portion, said annular flange and transition portion generating a back facing step at an interface thereof; and a flow conditioner inserted within said inlet concealing said back facing step to thereby smooth flow through said inlet.

8. The turbine inlet casing of claim 7 wherein said flow conditioner comprises an annular ring adapted to seat in said annular flange of said steam inlet, and a pair of wing portions extending from said annular ring in a flow direction, away from said annular ring.

9. The turbine inlet casing of claim 8 wherein each of said wing portions has exterior, convexly curved surfaces.

10. The turbine inlet casing of claim 7 wherein each of said wing portions tapers inwardly in the flow direction.

11. The flow conditioner of claim 7 wherein each of said wing portions also extend radially away from said annular ring in the flow direction.

12. The flow conditioner of claim 7 wherein one of said wings has a pair of side edges that are contiguous with a pair of side edges on the other of said wings.

13. The flow conditioner of claim 12 wherein the contiguous side edges lie in a flat plane.

14. A method of smoothing flow through an inlet of a steam turbine inlet casing wherein the inlet includes a circular flange and a non-circular transition portion extending between the annular flange and a main body portion of the steam turbine casing, the method comprising:

a) identifying surface discontinuities that disrupt flow of working fluid through the steam inlet; and b) providing a flow conditioner that is shaped to conceal one or more of said surface discontinuities; and c) inserting said flow conditioner into said inlet.

* * * * *